US007387545B2

(12) United States Patent
Tyler et al.

(10) Patent No.: US 7,387,545 B2
(45) Date of Patent: Jun. 17, 2008

(54) ELECTRICAL CONNECTOR WITH PRE-LOCKED TERMINAL POSITION ASSURANCE (TPA)

(75) Inventors: Adam P. Tyler, Rochester Hills, MI (US); Franklin A. Holub, West Bloomfield, MI (US)

(73) Assignee: FCI Americas Technology, Inc., Reno, NV (US)

( * ) Notice: Subject to any disclaimer, the term of this patent is extended or adjusted under 35 U.S.C. 154(b) by 107 days.

(21) Appl. No.: 11/389,389

(22) Filed: Mar. 24, 2006

(65) Prior Publication Data

US 2007/0224888 A1 Sep. 27, 2007

(51) Int. Cl.
*H01R 13/514* (2006.01)

(52) U.S. Cl. ..... 439/752; 439/595

(58) Field of Classification Search ..... 439/352, 439/595, 752, 157

See application file for complete search history.

(56) References Cited

U.S. PATENT DOCUMENTS

| | | | | |
|---|---|---|---|---|
| 4,708,413 | A | 11/1987 | Schroeder | 439/358 |
| 5,059,142 | A * | 10/1991 | Ohta et al. | 439/752 |
| 5,071,369 | A | 12/1991 | Denlinger et al. | 439/595 |
| 5,145,356 | A | 9/1992 | Minnis | 439/352 |
| 5,605,472 | A | 2/1997 | Sakai et al. | 439/489 |
| 5,622,521 | A * | 4/1997 | Marceau et al. | 439/595 |
| 5,628,648 | A | 5/1997 | Higgins, Jr. et al. | 439/489 |
| 5,643,003 | A | 7/1997 | Myer et al. | 439/352 |
| 5,681,178 | A | 10/1997 | Kunkle et al. | 439/352 |
| 5,730,625 | A | 3/1998 | Sikora | 439/595 |
| 5,928,038 | A | 7/1999 | Berg et al. | 439/752 |
| 5,947,763 | A | 9/1999 | Alaksin | 439/489 |
| 5,964,621 | A | 10/1999 | Wolla et al. | 439/595 |
| 6,004,153 | A | 12/1999 | Myer et al. | 439/352 |
| 6,045,404 | A | 4/2000 | Myer | 439/595 |
| 6,056,604 | A | 5/2000 | Roy et al. | 439/845 |
| 6,247,975 | B1 | 6/2001 | Cue | 439/845 |
| 6,261,115 | B1 | 7/2001 | Pederson et al. | 439/352 |
| 6,383,009 | B2 | 5/2002 | Kawase et al. | 439/352 |
| 6,406,319 | B2 | 6/2002 | Pederson et al. | 439/352 |
| 6,419,515 | B1 | 7/2002 | Okayasu | 439/358 |
| 6,514,098 | B2 | 2/2003 | Marpoe, Jr. et al. | 439/352 |
| 6,827,609 | B1 * | 12/2004 | Martin et al. | 439/595 |
| 6,913,494 | B2 * | 7/2005 | Ward et al. | 439/752 |
| 2001/0027058 | A1 | 10/2001 | Pederson et al. | 439/595 |
| 2005/0176298 | A1 | 8/2005 | Flowers et al. | 439/595 |
| 2005/0227548 | A1 | 10/2005 | Sian | 439/752 |
| 2005/0266738 | A1 * | 12/2005 | Martin et al. | 439/751 |

* cited by examiner

*Primary Examiner*—Tho D. Ta
*Assistant Examiner*—Larisa Z Tsukerman
(74) *Attorney, Agent, or Firm*—Harrington & Smith PC

(57) ABSTRACT

An electrical connector housing assembly including an electrical connector housing having electrical terminal receiving areas; and a terminal position assurance (TPA) member movably mounted to the electrical connector housing. The TPA member is latched to the electrical connector housing in a pre-lock position by lateral side latches of the TPA member. The side latches have sections adapted to be deflected in an inward direction to un-latch the TPA member from the pre-lock position.

19 Claims, 11 Drawing Sheets

ELECTRICAL CONNECTOR WITH PRE-LOCKED TERMINAL POSITION ASSURANCE (TPA)

BACKGROUND OF THE INVENTION

1. Field of the Invention

The invention relates to an electrical connector and, more particularly, to terminal position assurance in an electrical connector.

2. Brief Description of Prior Developments

U.S. Pat. No. 6,045,404, which is hereby incorporated by reference in its entirety, discloses a terminal position assurance (TPA) member used in an electrical connector. Electrical connectors are becoming increasingly small. There is a desire to provide an electrical connector having a TPA feature, but without significantly increasing the size of the connector. Female harness connectors shipped in bulk in boxes run the risk of having their TPA (Terminal Position Assurance) component bumped from the pre-lock position into a final-lock position. This situation, if unaddressed, could lead to customer inconvenience and dissatisfaction. Other possible solutions, like cell packaging, would have a significant negative impact on overall product cost.

There is a desire to provide a TPA feature on an electrical connector which is adapted to prevent inadvertent movement of the TPA feature from a pre-lock position to a lock position before intended. There is also a desire to provide this feature without increasing the size of the electrical connector.

SUMMARY OF THE INVENTION

In accordance with one aspect of the invention, an electrical connector housing assembly is provided including an electrical connector housing having electrical terminal receiving areas; and a terminal position assurance (TPA) member movably mounted to the electrical connector housing. The TPA member is latched to the electrical connector housing in a pre-lock position by lateral side latches of the TPA member. The side latches have sections adapted to be deflected in an inward direction to un-latch the TPA member from the pre-lock position.

In accordance with another aspect of the invention, an electrical connector housing assembly is provided comprising an electrical connector housing having electrical terminal receiving areas; and a terminal position assurance (TPA) member movably mounted to the electrical connector housing. The TPA member comprises a latching lever for holding the TPA member at a pre-lock position, wherein the latching lever comprises a first end adapted to be moved by a user, a middle section on a fulcrum of the electrical connector housing, and a second end latched with the electrical connector housing. The latching lever holds the TPA member in the pre-lock position on the electrical connector housing until fulcrum pivoted on the fulcrum of the electrical connector housing to an un-latched position by the user.

In accordance with another aspect of the invention, a terminal position assurance (TPA) member is provided comprising at least one projection adapted to engage at least one deflectable terminal latch of an electrical connector housing to prevent the terminal latch from deflecting; and at least one latching lever for holding the TPA member at a pre-lock position on the electrical connector housing. The latching lever is formed by two rearward extending outer slots and two forward extending inner slots.

In accordance with one method of the invention, a method of moving a terminal position assurance (TPA) member of an electrical connector is provided comprising latching the TPA member at a pre-lock position on a housing of the electrical connector; pressing portions of lateral side latches of the TPA member inward; moving the TPA member from the pre-lock position to a TPA lock position; and locating portions of the housing at inner sides of the portion of the lateral side latches to prevent the portions of the lateral side latches from deflecting inward while the TPA member is at the TPA lock position.

BRIEF DESCRIPTION OF THE DRAWINGS

The foregoing aspects and other features of the invention are explained in the following description, taken in connection with the accompanying drawings, wherein.

DETAILED DESCRIPTION OF THE PREFERRED EMBODIMENT

Figure 1:
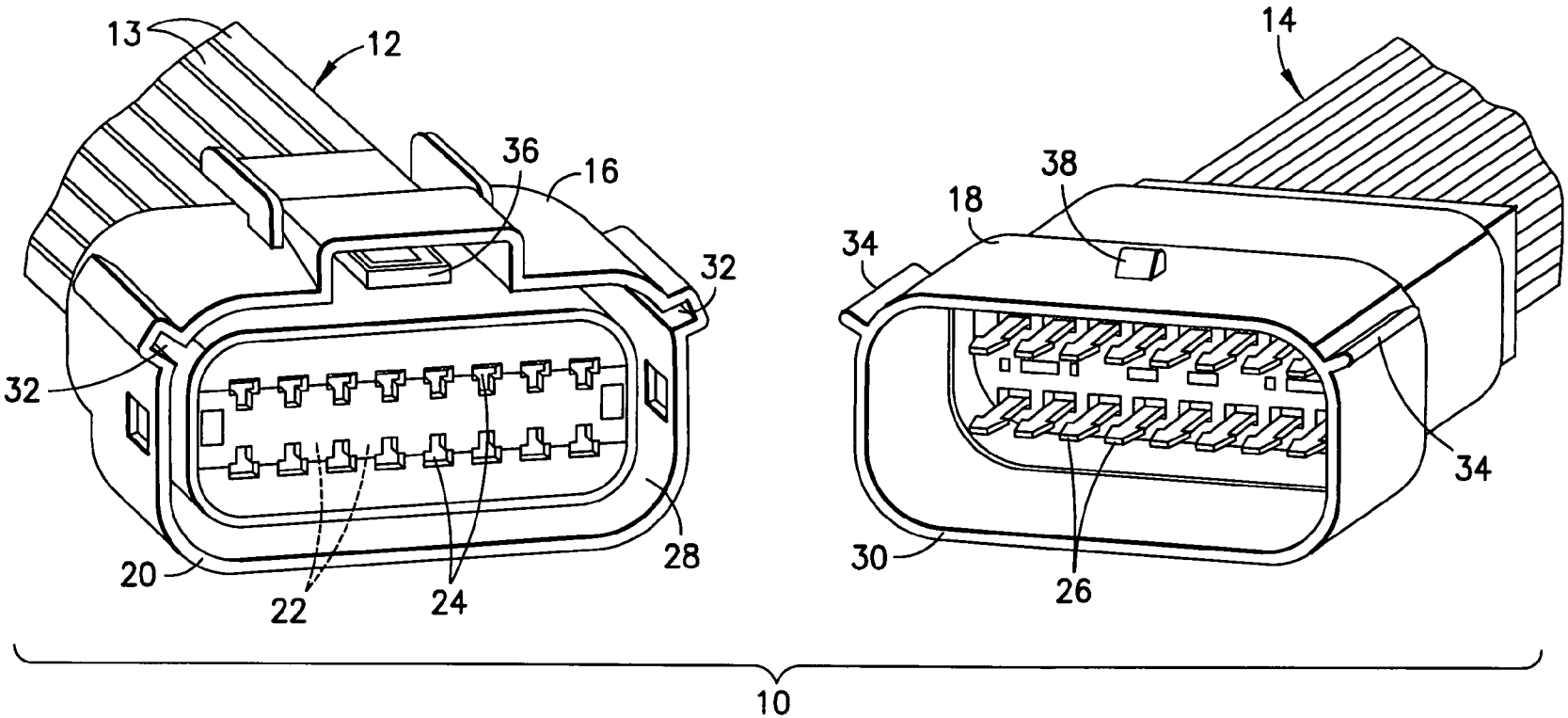
FIG. 1 PRIOR ART
FIG. 1 is an exploded perspective view of a conventional electrical connection system.

Referring to FIG. 1, there is shown an exploded perspective view of a conventional electrical connection system 10 for electrically connecting two groups 12, 14 of electrical conductors to each other. The electrical connection system 10 comprises a first electrical connector 16 connected to the first group 12 of electrical conductors 13 and a second electrical connector 18 connected to the second group 14 of electrical conductors. The first electrical connector 16 comprises a housing 20 and electrical contacts 22 located inside the housing 20. The housing 20 has receiving areas 24 in its front face for receiving male contacts 26 of the second electrical connector 18. The housing 20 also comprises the receiving area 28 for receiving the front end of the housing 30 of the second electrical connector 18. The receiving areas 28 comprises slots 32 for receiving polarizing ribs 34 of the second electrical connector 18. The housing 20 also comprises a latch 36 which extends into the receiving area 28.

The latch 36 is adapted to snap lock latch with the latch protrusion 38 of the housing 30 of the second electrical connector 18.

Figure 2:
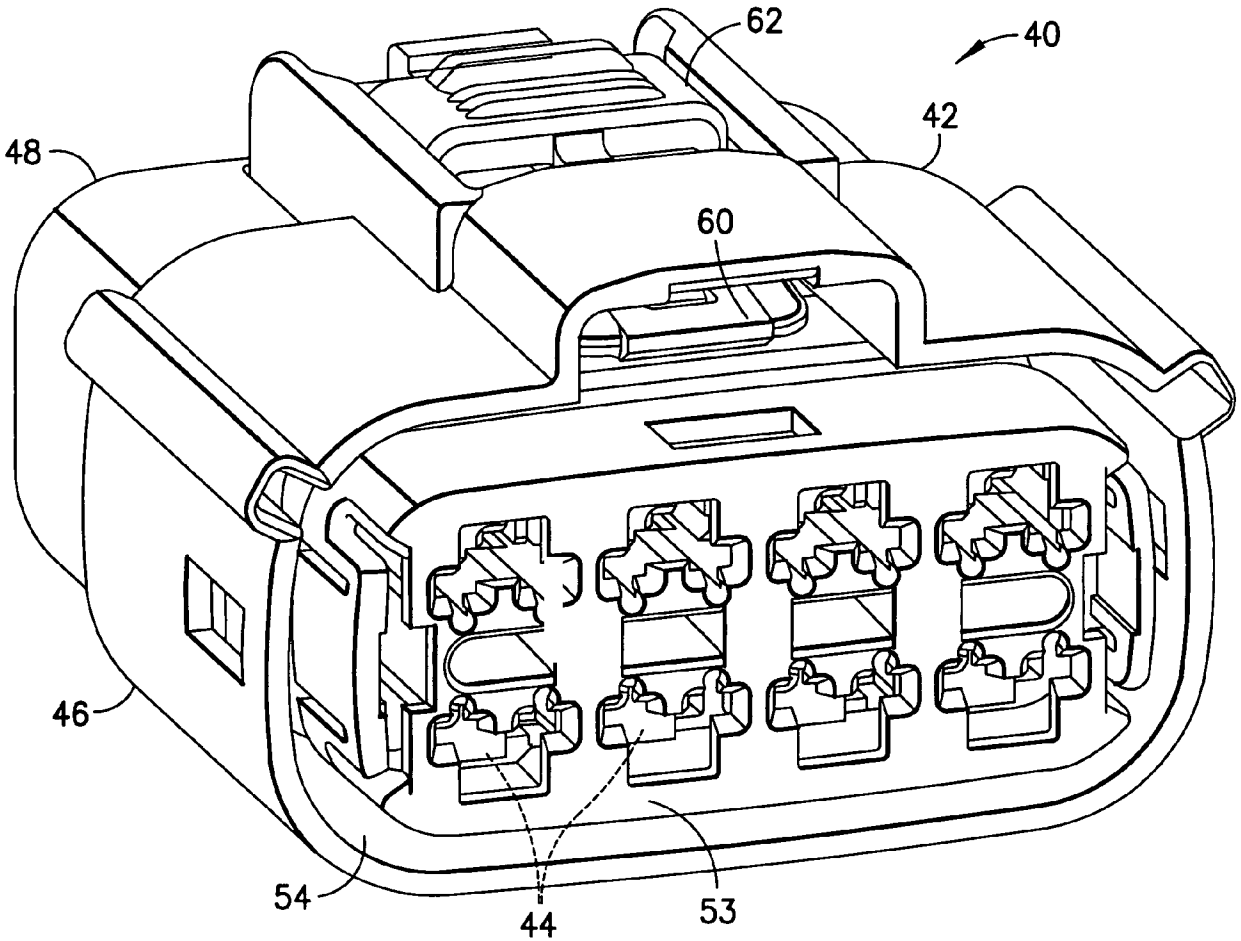
FIG. 2 is a perspective view of an electrical connector incorporating features of the invention.
Figure 3:
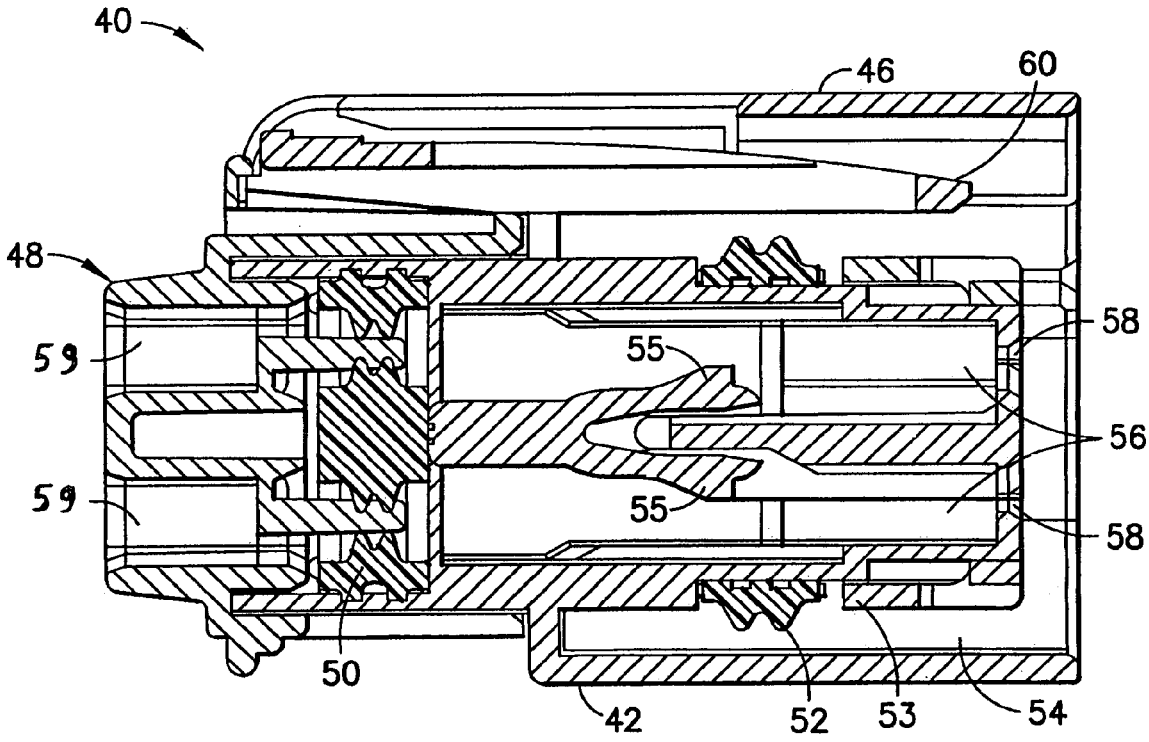
FIG. 3 is a cross sectional view of the electrical connector shown in FIG. 2, but without showing the electrical contacts and the CPA.
Figure 4:
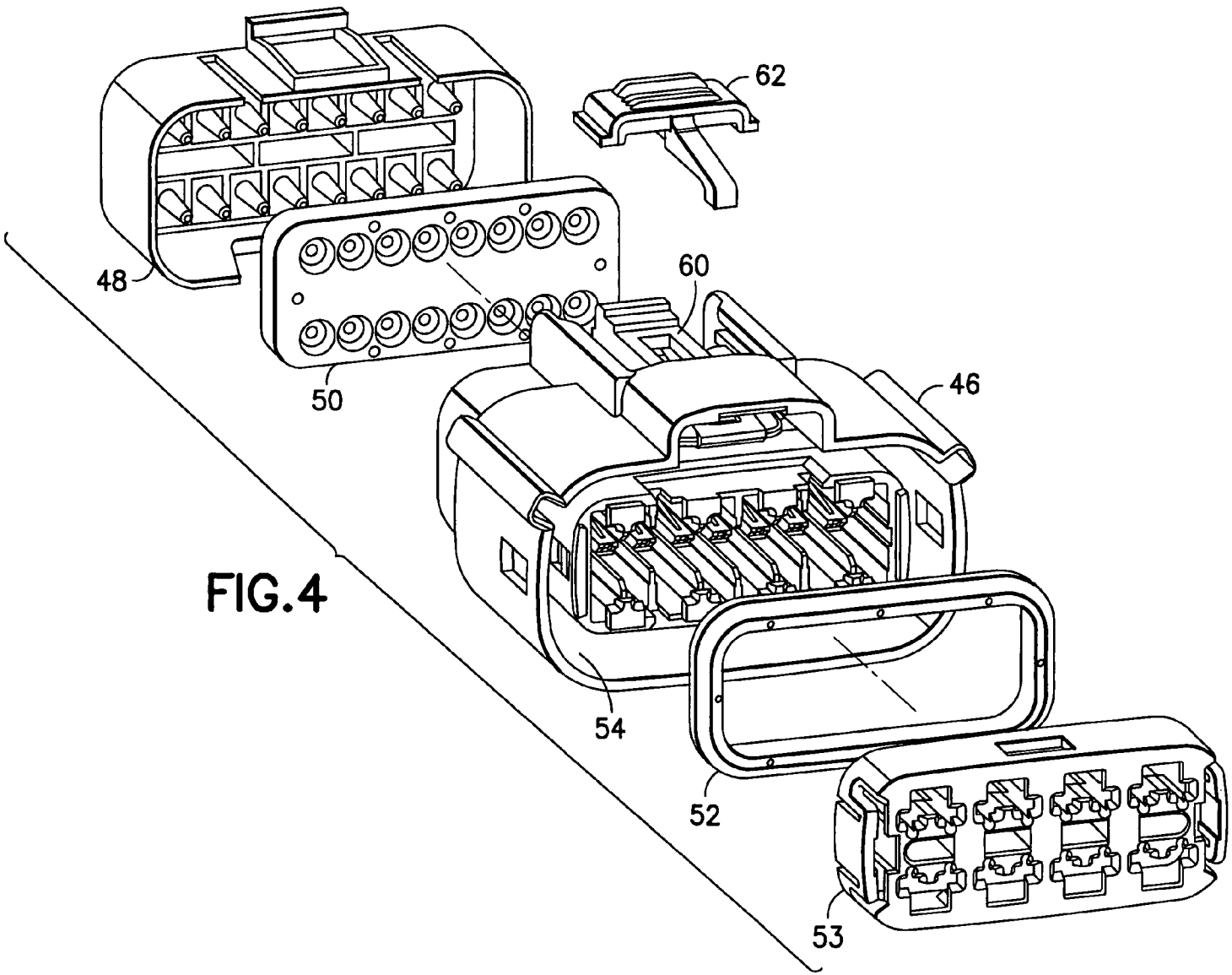
FIG. 4 is an exploded view of the electrical connector shown in FIGS. 2 and 3, but without showing the electrical contacts.

Referring to FIGS. 2-4, there is shown an electrical connector 40 incorporating features of the invention. Although the invention will be described with reference to the exemplary embodiment shown in the drawings, it should be understood that the invention can be embodied in many alternate forms of embodiments. In addition, any suitable size, shape or type of elements or materials could be used.

The electrical connector 40 is intended to replace or be used instead of the first electrical connector 16. In particular, the electrical connector 40 is adapted to be connected to the first group 12 of electrical conductors and be removably connected to the second electrical connector 18. The electrical connector 40 comprises a housing 42 and electrical contacts 44. The electrical contacts 44 are not shown in FIGS. 3 and 4 merely for the sake of clarity. The electrical contacts 44 are coupled to the electrical conductors 13 in the first group 12 of electrical conductors. The electrical contacts 44 comprise female contact sections adapted to receive the male contacts 26 of the second electrical connector 18. Similar electrical terminals are disclosed in U.S. Pat. Nos. 6,247,975 and 6,056,604 which are hereby incorporated by reference in their entireties. However, in alternate embodiments, any suitable type of electrical terminals could be used.

The housing 42 comprises a main housing member 46 and a seal retainer 48. The seal retainer 48 is fixedly connected to the rear end of the main housing member 46, such as by a snap lock connection, to capture a seal 50 between the seal retainer 48 at the main housing member 46. The seal 50 provides a seal with the electrical conductors 13. The electrical connector 40 also comprises a second seal 52 adapted to engage the housing 30 of the second electrical conductor 18 in the receiving area 54 of the main housing member 46. A terminal position assurance (TPA) member 53 forms a front seal retainer for the front seal 52. The TPA member 53 is attached to the front of the main housing member 46 to retain the front seal 52 on the main housing member 46 and to prevent terminal latches 55 from deflecting after the TPA member 53 is moved to a rearward lock position. The TPA member is designed to detect partially installed terminals by butting into the tip of a deflected lock finger. Preferably, the TPA member can only be installed into the final lock position if the terminal is properly locked in by the finger.

The main housing member 46 comprises contact receiving areas 56. The electrical contacts or terminals 44 are located in the contact receiving areas 56. The front end of the main housing member 46 comprises apertures 58 into the contact receiving areas 56. The apertures 58 are adapted to allow insertion of the male contacts 26 into the contact receiving areas 56 and into mating electrical connection with the electrical contacts 44. The electrical conductors 13 are adapted to extend through apertures 59 of the seal retainer 48 and into the contact receiving areas 56 where they are connected to the electrical contacts 44. The rear seal 50 is adapted to seal the rear end of the contact receiving areas 56 at the rear end of the main housing member 46 where the electrical conductors 13 pass into the rear end of the main housing member 46.

Figure 5:
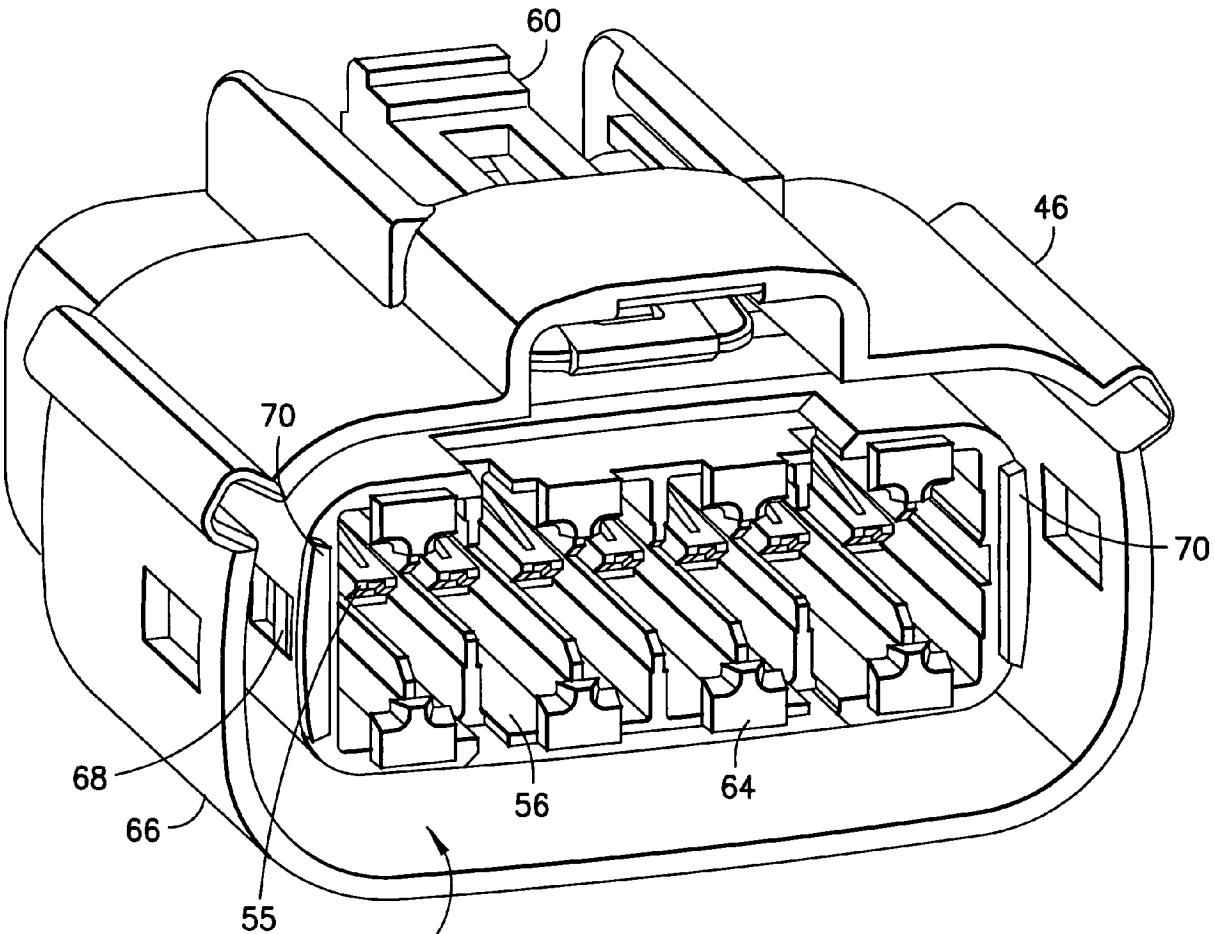
FIG. 5 is a perspective view of the main housing member shown in FIGS. 2-4.

Referring also to FIG. 5, the main housing member 46 comprises a mating electrical connector latch 60. When the electrical connector 40 is connected to the second electrical connector 18, the latch 60 is adapted to removably latch with the latch protrusion 38 of the second electrical connector 18. U.S. Patent Publication No. 2005/0215106 A1, which is hereby incorporated by reference in its entirety, describes the latch 60 and the connector position assurance (CPA) 62 used in the connector 40. However, in alternate embodiments, any suitable mating connector latch and CPA system could be provided.

Figure 6:
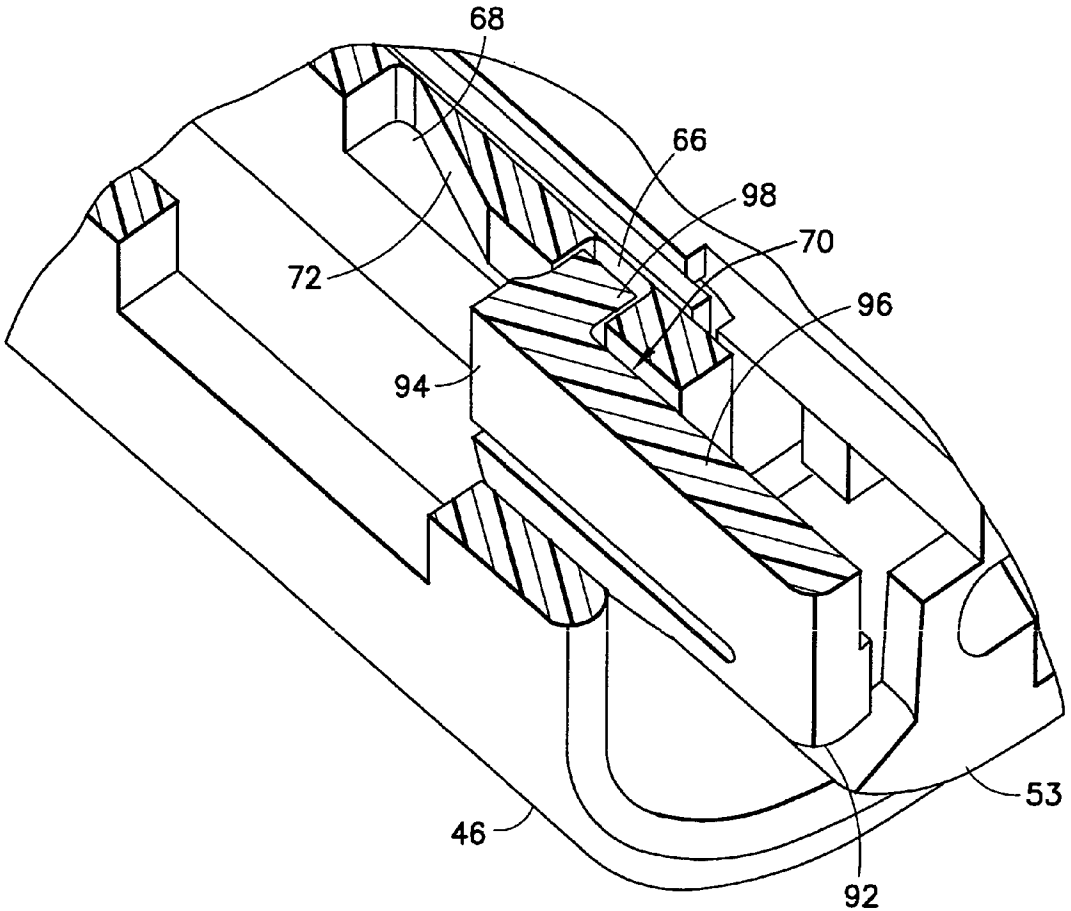
FIG. 6 is an enlarged sectional view of portions of the main housing member and the TPA member shown in FIGS. 2-4.

The housing 46 forms a center section 64 surrounded by the receiving area 54. The center section 64 defines the contact receiving areas 56. In this embodiment, the contact receiving areas 56 are aligned in two rows. However, in alternate embodiments, any suitable array of contact receiving areas could be provided. Referring also to FIG. 6, the opposite lateral sides of the center section 64 each comprise two detents or latch receiving areas 66, 68 and a fulcrum 70. The front area 66 is located rearward from the fulcrum 70. The rear area 68 is located rearward from the front area 66. A ramp 72 is provided between the front and rear areas 66, 68.

Figure 7:
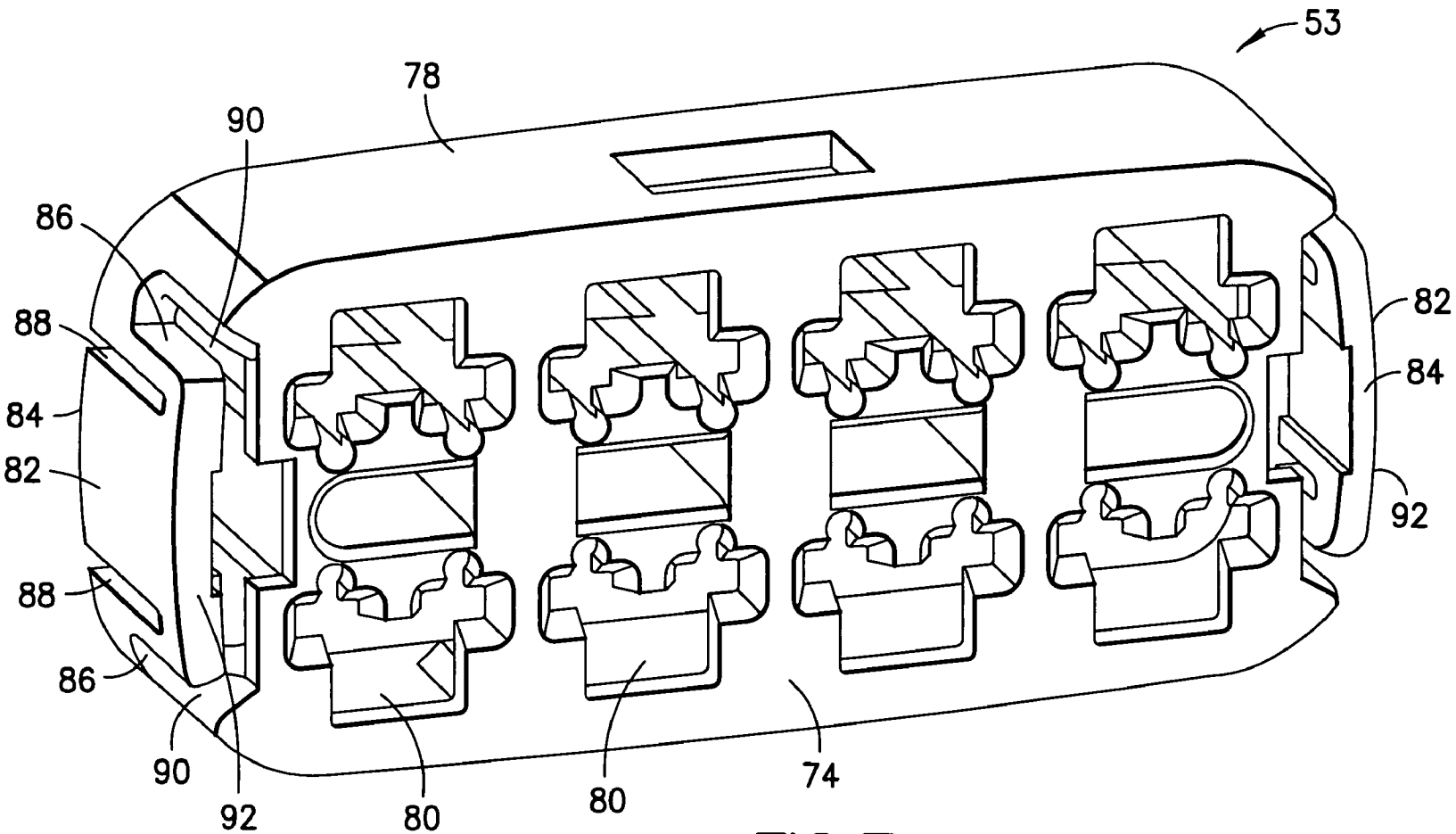
FIG. 7 is a front perspective view of the TPA member shown in FIGS. 2-4.
Figure 8:
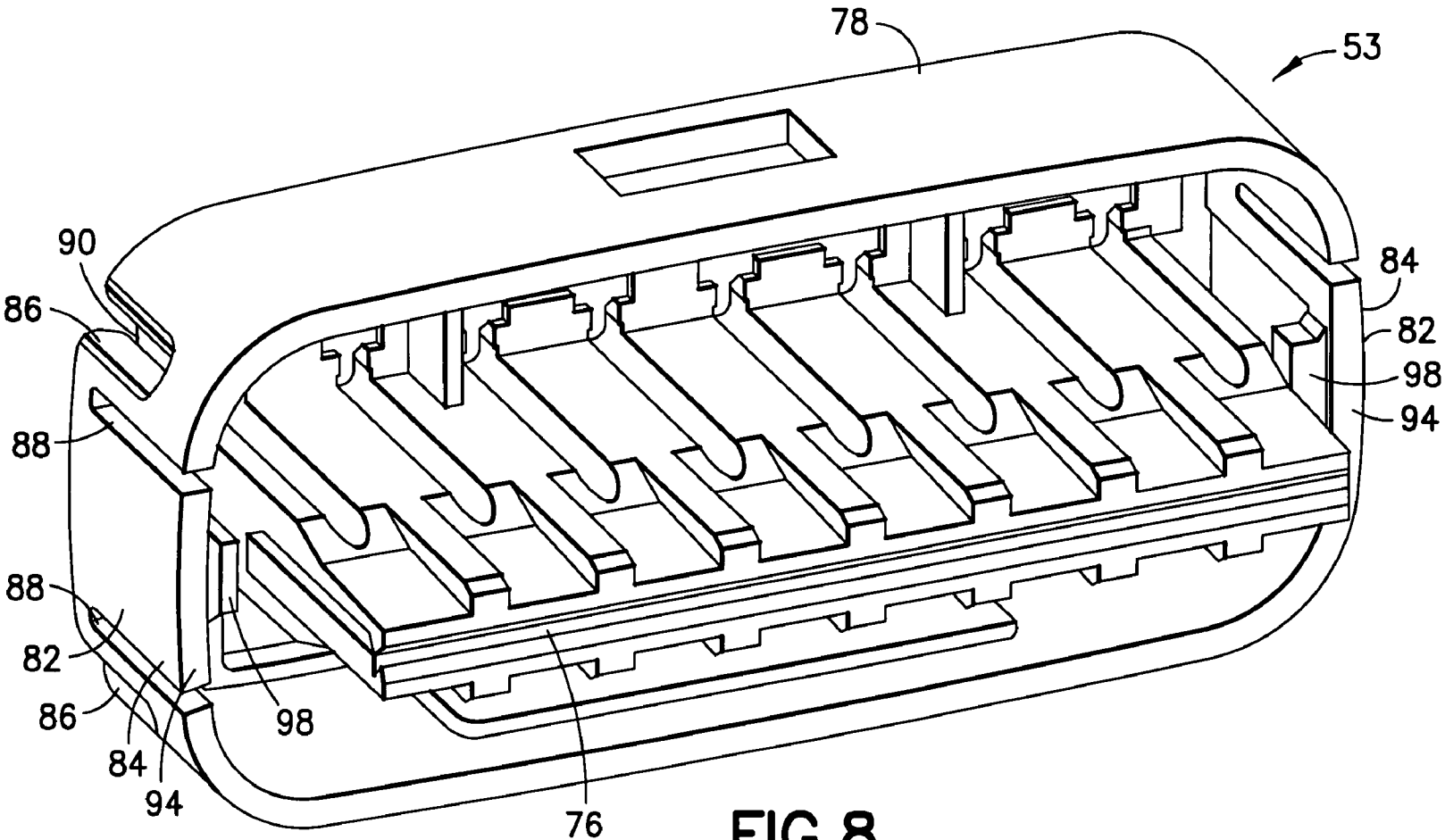
FIG. 8 is a rear perspective view of the TPA member shown in FIG. 7.
Figure 11:
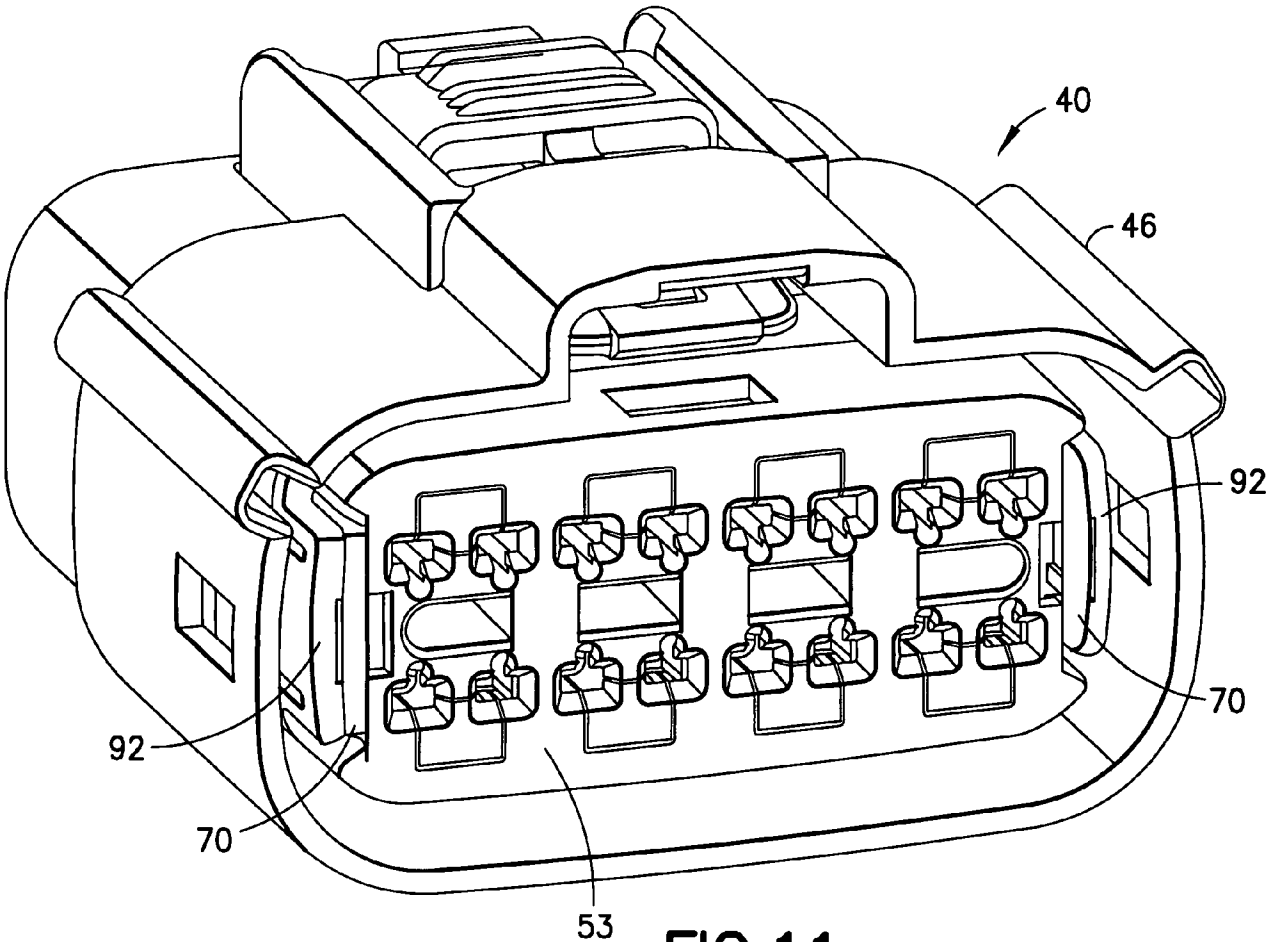
FIG. 11 is a perspective view of the electrical connector shown in FIGS. 2 and 9 with the TPA member moved to the lock position.

Referring also to FIGS. 7-8, the TPA member 53 generally comprises a one piece member made of molded plastic or polymer material. The TPA member 53 is movably mounted on the main housing member 46 between a forward location as seen in FIG. 2 and a rearward location as seen in FIG. 11. The TPA member 53 comprises a front end 74, a projection 76, and a perimeter section 78. The front end 74 has a plurality of contact holes 80 to allow male contacts of the connector 18 to enter the female contacts inside the areas 56. The projection 76 extends in a general cantilever fashion rearward from the rear side of the front end 74. In alternate embodiments, more than one projection 76 could be provided. When the TPA member 53 is moved to its rearward position, the projection 76 is adapted to contact the terminal latches 55 to prevent the latches 55 from deflecting. However, when the TPA member is located at its forward position, the terminal latches 55 are able to resiliently deflect inward to allow insertion or removal of the terminals 44 in the areas 56.

The perimeter section 78 forms lateral side walls of the TPA member 53. Each lateral side wall comprises a lateral side latch 82. Each latch 82 comprises a latching lever 84 connected on top and bottom sides by connecting sections 86. The latching lever 84 is formed by two rearward extending outer slots 88 and two forward extending inner slots 90. The inner slots 90 extend forward from a rear end of the TPA member. The outer slots 90 extend rearward from a front end of the TPA member. The inner slots 88 are located between the outer slots 90. With this arrangement, the latching levers 84 extend rearward from the front of the TPA member in a general cantilever fashion, but are connected to the rear of the TPA member by the connecting sections 86. In alternate embodiments, any suitable shape or configuration of the lateral side latches could be provided. In addition, in an alternate embodiment the TPA member might comprise more or less than two latching levers, and the latches could be located a one or more locations other than the lateral sides of the TPA member.

The latching levers each comprise a front end 92, a rear end 94 and a middle section 96 between the front and rear ends. The rear end 94 has an inward projecting latch projection 98. As shown in FIG. 6, when the TPA member 53 is at its forward location, the latch projection 98 is located in the front area 66. The middle section 96 is located at the fulcrum 70. The front end 92 is spaced forward from the fulcrum 70. This forward location of the TPA member 53 forms a pre-lock position for the TPA member on the main housing member 46.

Figure 9:
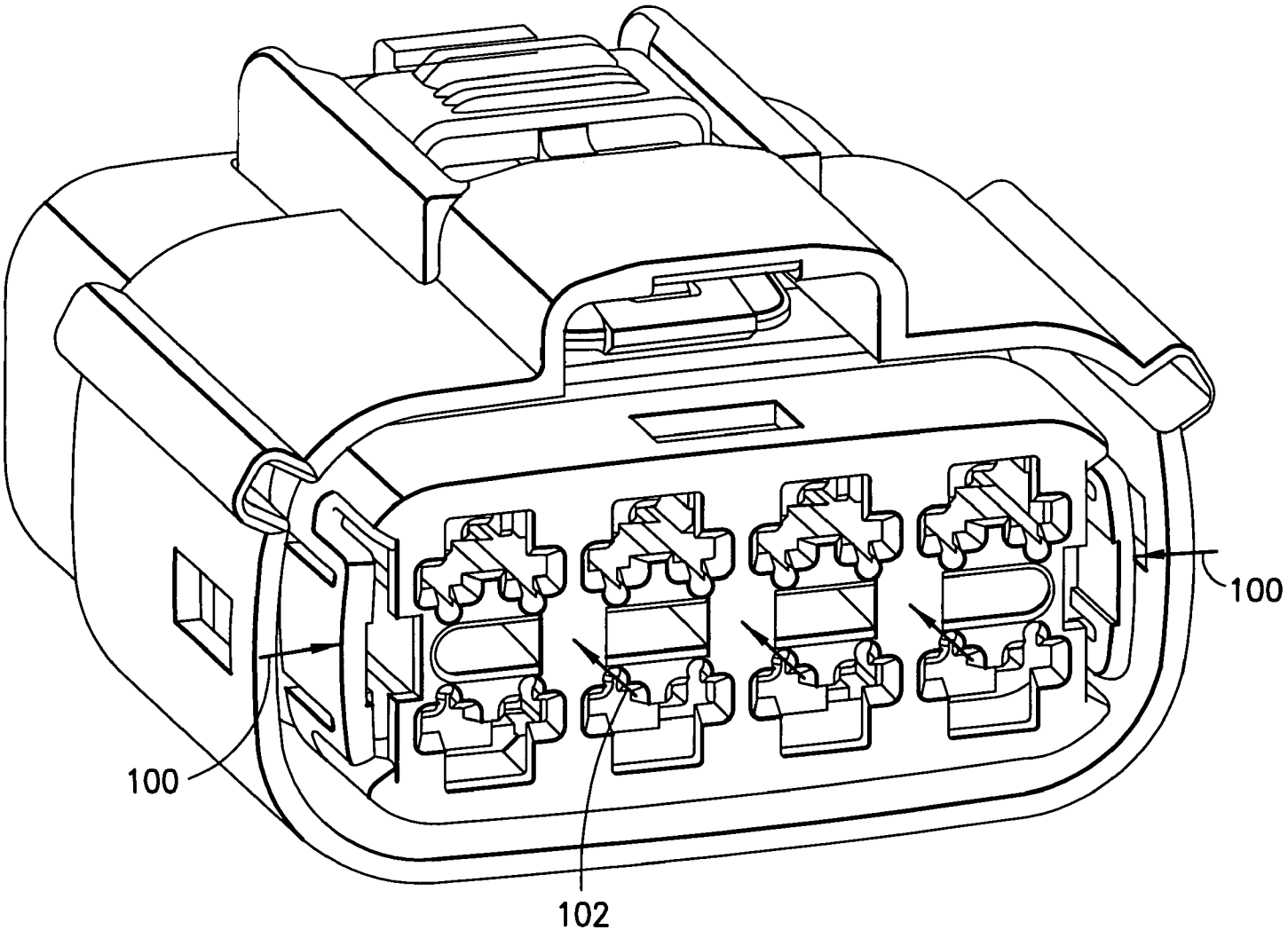
FIG. 9 is a perspective view of the electrical connector shown in FIG. 2 showing forces applied to the TPA member to move the TPA member from its pre-lock position to its lock position.

The pre-lock positioning of the TPA member retains the TPA member in its forward position on the main housing member 46 until positively moved by the user. The latch projection 98 retains the TPA member 53 in its forward position by being located in the front area 66. The TPA member 53 cannot be moved rearward until the latch projections 98 are moved out of the areas 66. In order to move the latch projections 98 out of the areas 66, a user presses the front ends 92 of the latching levers 84 inward as indicated by arrows 100 in FIG. 9. The movement of the front ends 92 inward causes the rear ends 94 of the levers to deflect outward. This is because of contact by the middle sections 96 with the fulcra 70. The levers pivot on the fulcra 70. The connecting sections 86 resiliently deform to allow the latching levers to pivot relative to the rest of the TPA member. When the rear ends 94 are moved in outward directions, the projections 98 are moved out of the front areas 66. The user can then press against the front end 74 of the TPA member 53 to slide the TPA member 53 rearward as indicated by arrows 102.

Figure 10:
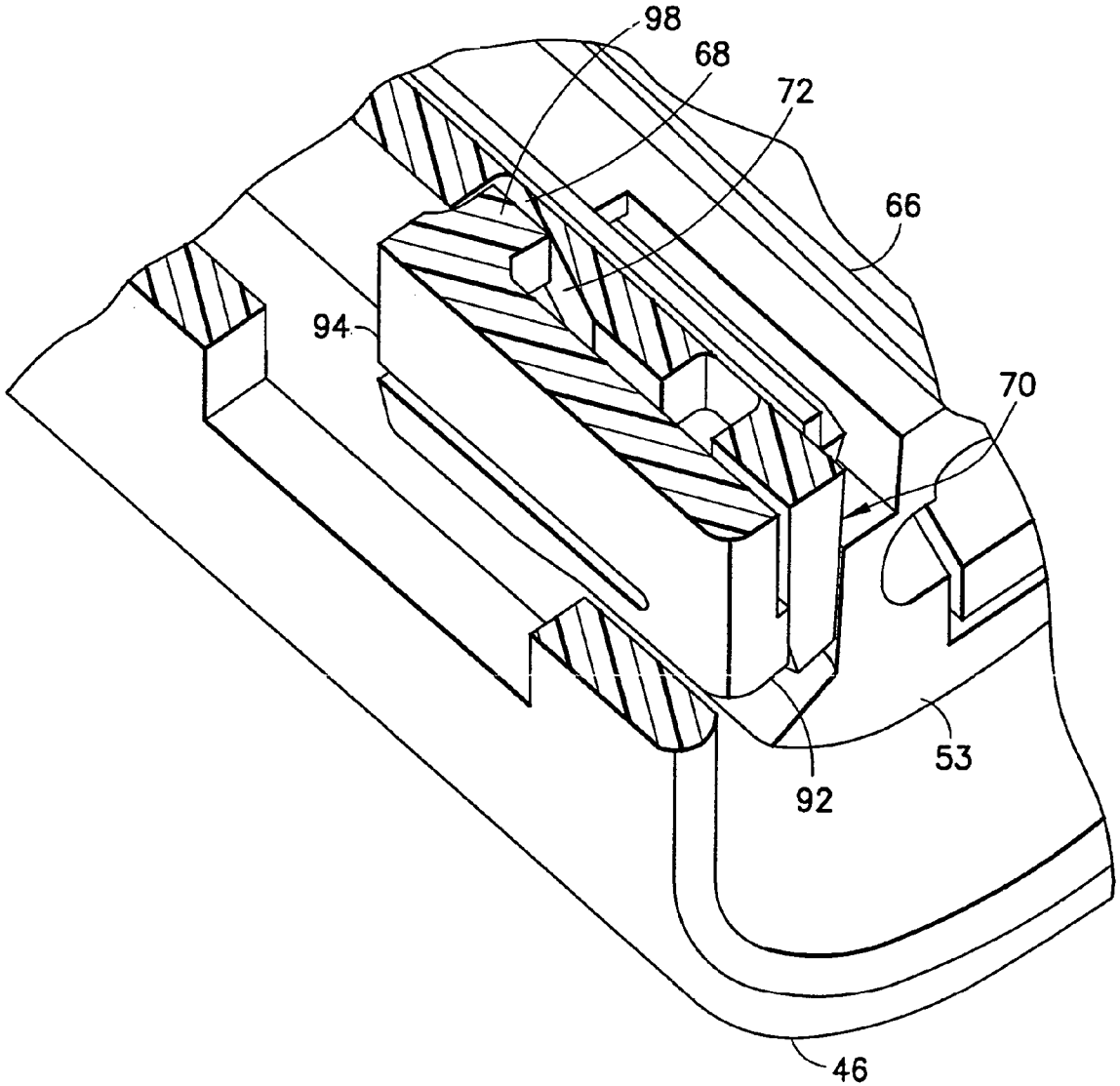
FIG. 10 is an enlarged sectional view of portions of the main housing member and the TPA member as shown in FIG. 6 with the TPA member moved to its lock position.

As the TPA member 53 is slid rearward, the projection 76 contacts the terminal latches 55 to prevent the latches 55 from deflecting, and thereby prevents the terminals 44 from being inadvertently pulled out of the receiving areas 56. Referring also to FIG. 10, when the TPA member 53 reaches the end of its rearward travel, it is located in its locked position. The latch projections 98 are located in the rear latch receiving areas 68. This prevents the TPA member 53 from moving forward again except as noted below. The inner surface of the front ends 92 are located at the fulcra 70. This prevents the front ends 92 from being pressed inward while the TPA member 53 is located at the locked position. Thus, this prevents a lever force being applied to the latching lever via the front ends 92 to move the rear ends 94 out of the rear latch receiving area 68. FIG. 11 shows the connector 40 after the TPA has been moved to its lock position.

In some circumstances the user might desire to move the TPA member 53 from its lock position to its pre-lock position. In this case, the user can pull on the TPA member 53 is a direction reverse to a direction 102. The ramps 72 can allow the rear ends 94 to deflect outward as the TPA member is moved forward by axial only force to allow the projections 98 move back into the front areas 66.

With the invention, a female harness connector can be provided in which the TPA component is positively held in the pre-lock position, until latches on either side of the TPA are depressed, releasing the TPA to be pushed into the final-lock position. Strategically placed cuts on the sides on the TPA can create a flexible latching feature. Protrusions on the front face of the housing can serve as a fulcrum for the TPA side latches while in the pre-lock position, and latch reinforcement while in the final lock position. The angles of the walls of the TPA retention detents on the connector housing, can be manufactured such that the TPA could be pulled from the final lock position back into the pre-lock position with axial force alone. However, movement of the TPA from the pre-lock position to the lock position would require axial as well as transverse force (to deflect the latches) to push the TPA from pre-lock into final lock.

Advantages of the invention include:

TPA is prevented from accidental movement from pre-lock to final-lock during shipping and handling;

Less expensive bulk packaging options can be used;

All features are simple in design, simple to use, and easily tooled;

The invention can be incorporated into a connector without increasing the size of the connector (for example, the connector 40 can be the same overall size as the connector 16).

In an alternate embodiment, the TPA side latches could be made to work without the fulcra on the housing.

It should be understood that the foregoing description is only illustrative of the invention. Various alternatives and modifications can be devised by those skilled in the art without departing from the invention. Accordingly, the invention is intended to embrace all such alternatives, modifications and variances which fall within the scope of the appended claims.

What is claimed is:

1. An electrical connector housing assembly comprising:

an electrical connector housing having electrical terminal receiving areas and a fulcrum; and a terminal position assurance (TPA) member movably mounted to the electrical connector housing, wherein the TPA member is latched to the electrical connector housing in a pre-lock position by lateral side latches of the TPA member, and wherein the side latches have sections adapted to be deflected in an inward direction to un-latch the TPA member from the pre-lock position, wherein the lateral side latches each comprise a latching lever adapted to pivot on the fulcrum of the housing.

2. An electrical connector housing assembly as in claim 1 wherein the sections adapted to be deflected in an inward direction comprise front ends of the latching levers.

3. An electrical connector housing assembly as in claim 1 wherein each side latch is adapted to pivot on the fulcra when the sections of the side latches are deflected in the inward direction to un-latch the TPA member from the pre-lock position, and wherein the TPA member is adapted to be moved to a lock position with the fulcra of the housing being located at the sections of the side latches of the TPA member to prevent the sections of the TPA member from deflecting in the inward direction when the TPA member is at the lock position.

4. An electrical connector comprising:

an electrical connector housing assembly as in claim 1; and electrical contacts mounted in the electrical terminal receiving areas.

5. An electrical connector housing assembly as in claim 3 wherein, when the TPA member is moved from the lock position to the pre-lock position, the lateral side latches are adapted to deflect without initially deflecting the sections of the TPA member in the inward direction.

6. An electrical connector housing assembly comprising:

an electrical connector housing having electrical terminal receiving areas and a fulcrum; and a terminal position assurance (TPA) member movably mounted to the electrical connector housing, wherein the TPA member is latched to the electrical connector housing in a pre-lock position by lateral side latches of the TPA member, and wherein the side latches have sections adapted to be deflected in an inward direction to un-latch the TPA member from the pre-lock position, wherein each latching lever is formed by two outer slots which extend rearward from a front end of the TPA member and two inner slots located between the two outer slots which extend forward from a rear end of the TPA member.

7. An electrical connector housing assembly comprising:

an electrical connector housing having electrical terminal receiving areas and a fulcrum; and a terminal position assurance (TPA) member movably mounted to the electrical connector housing, wherein the TPA member comprises a latching lever for holding the TPA member at a pre-lock position, wherein the latching lever comprises a first end adapted to be moved by a user, a middle section on the fulcrum of the electrical connector housing, and a second end latched with the electrical connector housing, wherein the latching lever holds the TPA member in the pre-lock position on the electrical connector housing until pivoted on the fulcrum of the electrical connector housing to an un-latched position by the user.

8. An electrical connector housing assembly as in claim 7 wherein the TPA member comprises two of the latching levers located at opposite lateral sides of the TPA member.

9. An electrical connector housing assembly as in claim 7 wherein the latching lever is formed by two outer slots which extend rearward from a front end of the TPA member and two inner slots located between the two outer slots which extend forward from a rear end of the TPA member.

10. An electrical connector housing assembly as in claim 7 wherein, when the TPA member is moved to a lock position, the first end of the lateral side latch is located at the fulcrum of the electrical connector housing to substantially prevent the first end from being deflected inward by the user when the TPA member is at the lock position.

11. An electrical connector housing assembly as in claim 7 wherein the electrical connector housing comprises a first latch receiving area located rearward from the fulcrum, a second latch receiving area located rearward from the first latch pocket, and a ramp surface between the first and second latch pockets.

12. An electrical connector comprising;

an electrical connector housing assembly as in claim 7; and electrical contacts mounted in the electrical terminal receiving areas.

13. A method of moving a terminal position assurance (TPA) member of an electrical connector comprising:

latching the TPA member at a pre-lock position on a housing of the electrical connector;

pressing portions of lateral side latches of the TPA member inward to pivot the portions on a fulcra of the housing;

moving the TPA member from the pre-lock position to a TPA lock position; and locating portions of the housing at inner sides of the portion of the lateral side latches to prevent the portions of the lateral side latches from deflecting inward while the TPA member is at the TPA lock position.

14. A method as in claim 13 wherein the portions of the lateral side latches comprise forward portions of the lateral side latches, and wherein pressing the portions of the lateral side latches of the TPA member inward comprises fulcrum pivoting the lateral side latches on fulcra of the housing by pressing the forward portions of the lateral side latches inward.

15. A method as in claim 14 wherein fulcrum pivoting the lateral side latches on fulcra of the housing comprises moving rear portions of the lateral side latches in opposite outward directions.

16. A method as in claim 14 further comprising moving the TPA member from the TPA lock position to the pre-lock position by moving the TPA member forward on the housing without substantially moving the forward portions of the lateral side latches inward.

17. A terminal position assurance (TPA) member comprising:

at least one projection adapted to engage at least one deflectable terminal latch of an electrical connector housing to prevent the terminal latch from deflecting; and at least one latching lever for holding the TPA member at a pre-lock position on the electrical connector housing, wherein the latching lever is formed by two rearward extending outer slots and two forward extending inner slots.

18. A terminal position assurance (TPA) member as in claim 17 wherein the inner slots extend forward from a rear end of the TPA member, wherein the outer slots extend rearward from a front end of the TPA member, and wherein the inner slots are located between the outer slots.

19. A terminal position assurance (TPA) member as in claim 17 wherein the latching lever comprises a first end adapted to be deflected inward by a user, a middle section adapted to be located on a fulcrum of the electrical connector housing, and a second end adapted to latch with the electrical connector housing, wherein the latching lever is adapted to hold the TPA member in the pre-lock position on the electrical connector housing until pivoted on the fulcrum of the electrical connector housing to an un-latched position by the user.

* * * * *